US011519369B1

(12) United States Patent
Dupre et al.

(10) Patent No.: US 11,519,369 B1
(45) Date of Patent: Dec. 6, 2022

(54) FUEL SUPPLY SYSTEM

(71) Applicant: Delta Fuel Company, L.L.C., Ferriday, LA (US)

(72) Inventors: Joel E. Dupre, Natchez, MS (US); Adam Vegas, Ferriday, LA (US)

(73) Assignee: DELTA FUEL COMPANY, L.L.C., Natchez, MS (US)

( * ) Notice: Subject to any disclaimer, the term of this patent is extended or adjusted under 35 U.S.C. 154(b) by 0 days.

(21) Appl. No.: 16/864,331

(22) Filed: May 1, 2020

Related U.S. Application Data

(60) Provisional application No. 62/899,464, filed on Sep. 12, 2019, provisional application No. 62/842,944, filed on May 3, 2019.

(51) Int. Cl.

| | |
|---|---|
| ***F02M 37/00*** | (2006.01) |
| ***F02M 31/20*** | (2006.01) |
| ***F02M 37/54*** | (2019.01) |
| ***B67D 7/04*** | (2010.01) |
| ***B67D 7/58*** | (2010.01) |
| ***B67D 7/78*** | (2010.01) |
| ***E21B 43/26*** | (2006.01) |

(52) U.S. Cl.
CPC ..... *F02M 37/0023* (2013.01); *B67D 7/04* (2013.01); *B67D 7/58* (2013.01); *B67D 7/78* (2013.01); *F02M 31/20* (2013.01); *F02M 37/007* (2013.01); *F02M 37/0052* (2013.01); *F02M 37/0094* (2013.01); *F02M 37/54* (2019.01); *E21B 43/2607* (2020.05); *F02M 37/0017* (2013.01)

(58) Field of Classification Search
CPC ..... F02M 31/20; F02M 37/0017; F02M 37/0023; F02M 37/0052; F02M 37/007; F02M 37/0088; F02M 37/0094; F02M 37/54; E21B 43/26; E21B 43/2607; B67D 7/04; B67D 7/58; B67D 7/78
See application file for complete search history.

(56) References Cited

U.S. PATENT DOCUMENTS

| | | | | |
|---|---|---|---|---|
| 6,945,288 | B1 * | 9/2005 | Brakefield | B67D 7/04 141/231 |
| 11,208,880 | B2 * | 12/2021 | Yeung | E21B 43/2607 |
| 2006/0042606 | A1 * | 3/2006 | Van Dyke | B60K 15/03006 123/527 |
| 2009/0314384 | A1 * | 12/2009 | Brakefield | B67D 7/04 141/67 |
| 2013/0240066 | A1 * | 9/2013 | Ono | F02M 37/0088 137/565.01 |

(Continued)

*Primary Examiner* — John M Zaleskas
(74) *Attorney, Agent, or Firm* — Jones Walker LLP

(57) ABSTRACT

A remote fuel supply system comprising a fuel transfer unit for managing the flow of fuel from a remote fuel tank and onboard auxiliary tank to an engine. The system may include an engine unit comprising an onboard auxiliary tank, a remote fuel supply unit comprising a remote fuel tank, and a fuel transfer unit. The fuel transfer unit may include a housing featuring multiple inlets for receiving fresh fuel from the fuel supply unit and unburnt fuel from the engine unit, and the housing may include multiple outlets connected to diverter valves for selectively transferring fuel to the engine unit from the fuel supply sources; namely, the fresh fuel from the fuel supply unit and/or the unburnt fuel from the engine unit.

16 Claims, 5 Drawing Sheets

(56) References Cited

U.S. PATENT DOCUMENTS

| | | | | |
|---|---|---|---|---|
| 2014/0261695 | A1* | 9/2014 | Dehring | E21B 41/00 137/1 |
| 2016/0076533 | A1* | 3/2016 | Moffitt, Jr. | B67D 7/52 137/565.13 |
| 2017/0275149 | A1* | 9/2017 | Schmidt | B67D 7/0401 |
| 2019/0119096 | A1* | 4/2019 | Haile | B67D 7/303 |
| 2019/0337795 | A1* | 11/2019 | Shock | B67D 7/70 |
| 2019/0359475 | A1* | 11/2019 | Schmidt | B67D 7/58 |
| 2020/0062577 | A1* | 2/2020 | Meredith | B65H 75/425 |
| 2020/0062578 | A1* | 2/2020 | Shock | B67D 7/78 |
| 2020/0369507 | A1* | 11/2020 | Cady | B67D 7/36 |
| 2021/0017013 | A1* | 1/2021 | Schmidt | G05D 9/12 |
| 2021/0017890 | A1* | 1/2021 | Schmidt | F01N 3/2896 |

* cited by examiner

FUEL SUPPLY SYSTEM

CROSS-REFERENCE TO RELATED APPLICATION

This application claims the benefit of U.S. Provisional Application No. 62/842,944, filed May 3, 2019 and U.S. Provisional Application No. 62/899,464, filed Sep. 12, 2019, each of which are hereby incorporated by reference.

BACKGROUND OF THE INVENTION

Hydraulic fracturing is a process widely used in the oil and gas production industry. Hydraulic fracturing generally involves pumping large volumes of fluid into a wellbore at high pressures in order to fracture a hydrocarbon-containing formation and produce additional pathways for the extraction of oil and gas from the formation. The pumping systems required to produce the fracturing pressures are typically powerful pumps driven by diesel engines. These pumping systems are normally mounted on trailers ("frac trailers") or dedicated truck platforms ("frac trucks") in order to readily transport and position the fracturing equipment at the well site. Typically multiple frac trailers or frac trucks will be positioned at a well site in order to supply the total pumping capacity needed to effectively fracture the formation.

The hydraulic fracturing process can also require many hours of the pumping systems' continuous operation, thereby requiring substantial fuel reserves to power the motors of the pumps and any required generators. The fuel is normally transported to the well site in a conventional fuel tanker truck and fuels lines extend from the tanker truck to the frac trailers/trucks. The area of high pressure piping around the well site and the frac trailers/trucks is often referred to as the "hot zone" due to the increased explosion and fire dangers. To the extent that personnel can accomplish fuel line hookups while remaining outside the hot zone, the risks of personal injury and death are reduced. Therefore, methods and devices enabling quick and efficient fuel line hookups that keep personnel outside the hot zone pumping operations increase overall safety in fracturing operations.

SUMMARY OF SELECTED EMBODIMENTS

One embodiment of the invention is a fuel supply system which includes an engine unit, a fuel supply unit, and a transfer unit. The engine unit includes an engine, a fuel saddle tank, and an engine pump adapted to deliver fuel to the engine. The fuel supply unit includes a fuel supply tank, a supply pump configured to transfer fuel to the supply tank, and a manifold receiving fuel from the supply tank. The transfer unit is (i) spaced apart from the fuel supply unit, (ii) includes a housing having a volume of less than 10 $ft^3$ and an inlet to receive fuel from an outlet of the manifold. The transfer unit also has at least two multi-way valves configured to establish (1) at least two alternative paths for directing fuel to the engine pump, and (2) at least two alternative paths for receiving fuel from the engine. A first path directs fuel from the manifold outlet to the engine pump and a second path directs fuel from the saddle tank to the engine pump.

Another embodiment is the fuel transfer unit itself. This fuel transfer unit has a housing including (i) a volume of less than 5 $ft^3$, and a face configured to open, thereby providing access to an interior of the box, (ii) a fuel supply inlet, (iii) an engine return, (iv) a saddle tank outlet, (v) a saddle tank inlet, and (vi) an engine pump outlet. A first three way diverter valve has a first position connecting the fuel supply inlet to the engine pump inlet and a second position connecting the saddle tank outlet to the engine pump inlet. A second three way diverter valve has a first position connecting the engine overflow inlet to the fuel supply inlet and second position connecting the engine overflow inlet to the saddle tank inlet.

A further embodiment is a method of establishing a fuel supply into a wellsite hot-zone. The hot-zone includes an engine unit having an engine, a fuel saddle tank, and an engine pump adapted to deliver fuel to the engine. The method includes the first step of positioning a fuel supply unit outside the hot-zone, where the fuel supply unit includes a fuel supply tank, a supply pump configured to transfer fuel to the supply tank, and a manifold receiving fuel from the supply tank. A first fuel line is configured to receive fuel from an outlet of the manifold and direct fuel to at least one of the engine pump or fuel saddle tank, while a second fuel line is configured to receive return fuel from the engine and a fuel cooler, and to direct fuel back into the first fuel line.

DETAILED DESCRIPTION OF SELECTED EMBODIMENTS

Figure 5:
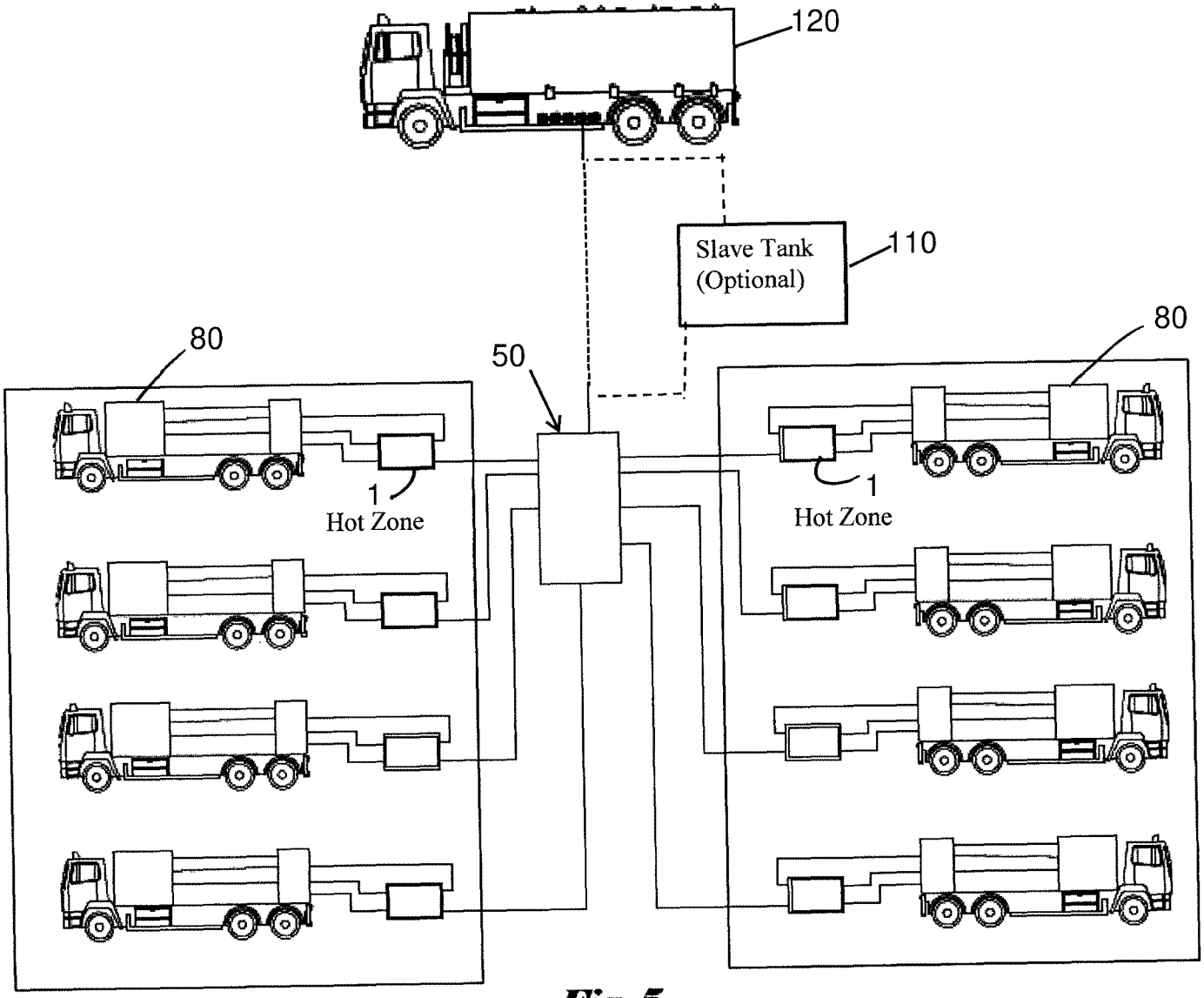
FIG. 5 is a diagram showing use of the FIG. 4A embodiment with multiple engine units and transfer units.

In its general form, most embodiments of the invention will include a fuel supply unit, an engine unit, and a transfer unit interconnecting the fuel supply unit and the engine unit. FIG. 5 suggests schematically one general environment in which many embodiments of the invention could be employed. A fuel truck 120 supplies fuel to a fuel supply unit 50, which in turn distributes the fuel to multiple frac trucks 80 via the fuel transfer units 1. In an alternative configuration, fuel truck 120 would supply slave tank 110, which in turn would feed supply unit 50. The frac trucks 80 could alternatively be frac trailers or could be any other item of engine driven equipment which requires fuel re-supply. The term "engine unit" 80 is used to denote all such examples of engine driven equipment, including frac trucks/trailers. Normally the engine units will be diesel powered, but the invention could have application to gasoline or other fuel powered systems.

Figure 4A:
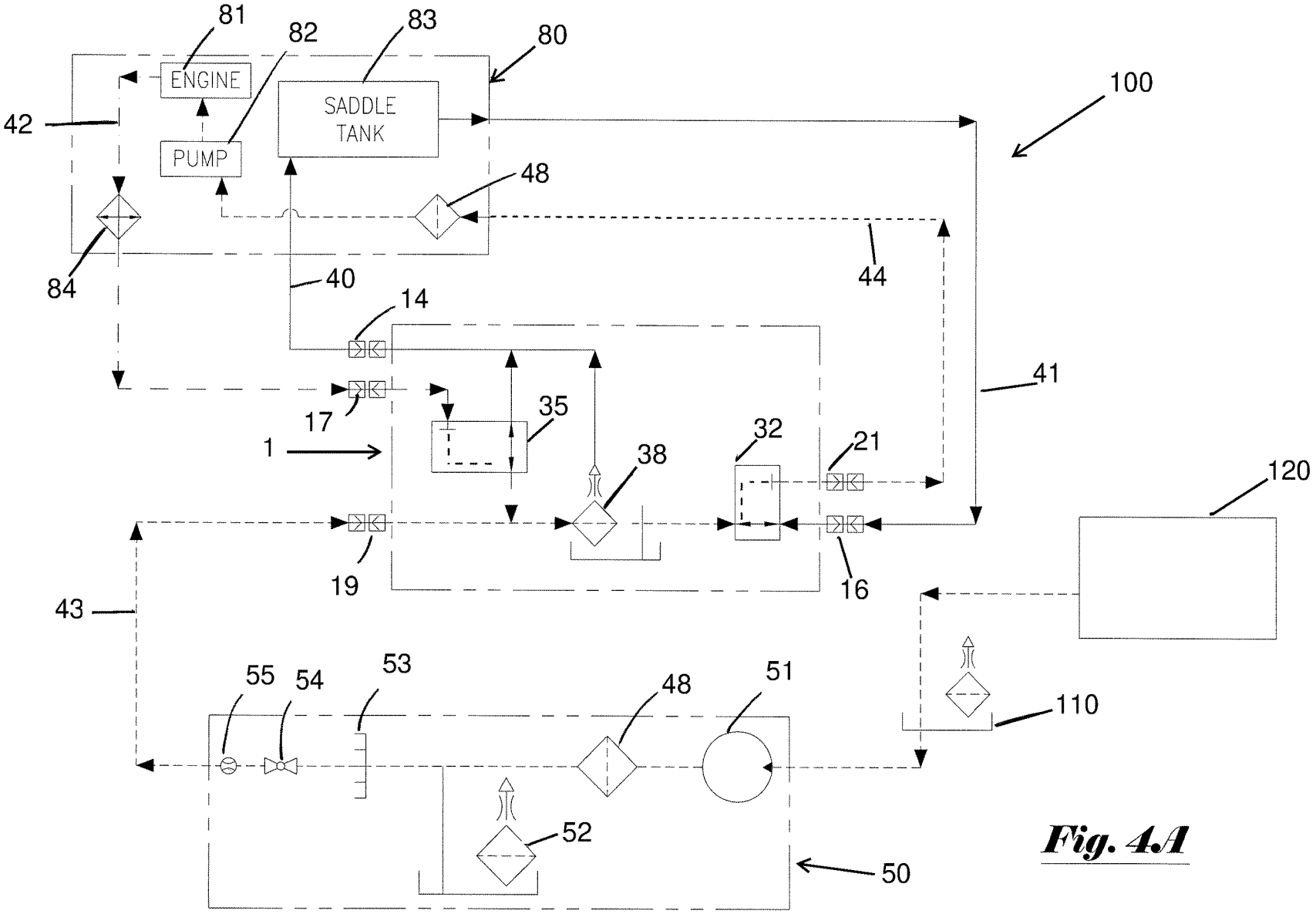
FIG. 4A is a flow diagram of one embodiment of the fuel supply system of the present invention.

FIG. 4A schematically illustrates fuel supply unit 50, engine unit 80, and transfer unit 1 as blocks with subcomponents shown as symbols within the blocks. The embodiment of engine unit 80 seen in FIG. 4A includes the engine 81, the fuel pump 82 which supplies fuel to engine 81, and a "saddle" tank 83, which is the most local fuel tank (which is typically mounted on or adjacent to the engine 81). In the case of a frac truck or frac trailer, the engine 81 drives the main frac pump(s) (not shown in FIG. 4A) which are pressurizing the frac fluid. The main frac pump(s) should not be confused with the fuel pump 82 seen in FIG. 4A-FIG. 4A is merely illustrating the relevant components of a generic "engine unit" which could drive a frac pump or any number of other equipment examples requiring a mechanical power source. Nonlimiting examples of other equipment may include blender units, hydration units, or pump-down engines. Not all embodiments of an "engine unit" need include saddle.

Additional details of the fuel supply unit 50 and the transfer unit 1 can also be seen in FIG. 4A. In the FIG. 4A embodiment, the fuel supply unit 50 generally includes the pump 51, the supply tank 52, and the manifold 53. The fuel filter 48 filters fuel before it enters supply tank 52, while flow meter 55 measures the fuel flow exiting valve 54. Valve 54 allows for fuel flow from supply unit 50 to be selectively shut-off and resumed. In many embodiments, supply tank 52 has a capacity of between about 1000 and about 5000 gallons. In one preferred embodiment, the components of fuel supply unit 50 will be mounted on a trailer, a truck bed, or other transport platform, e.g., some type of "wheeled chassis." Preferably, the transport platform will elevate the supply tank between 1 and 10 feet above (more preferably between 1 and 5 feet above) the inlet of the transfer unit 1, which often will be mounted on the engine unit 80. In the embodiment seen in FIG. 4A, a slave tank 110 receives fuel from fuel truck 120 before the fuel is transferred to fuel supply unit 50. The slave tank 110 is often used in order to provide a reserve storage of fuel without the need of a tanker truck constantly being present, but the slave tank is not needed in all embodiments. Similarly, not all embodiments require a fuel supply tank to be at an elevation position above the engine unit. Other embodiments, rather than relying on hydrostatic pressure of an elevated fuel supply tank, may rely solely on the suction of the engine unit's fuel pump to pull fuel from a supply tank.

Figure 1:
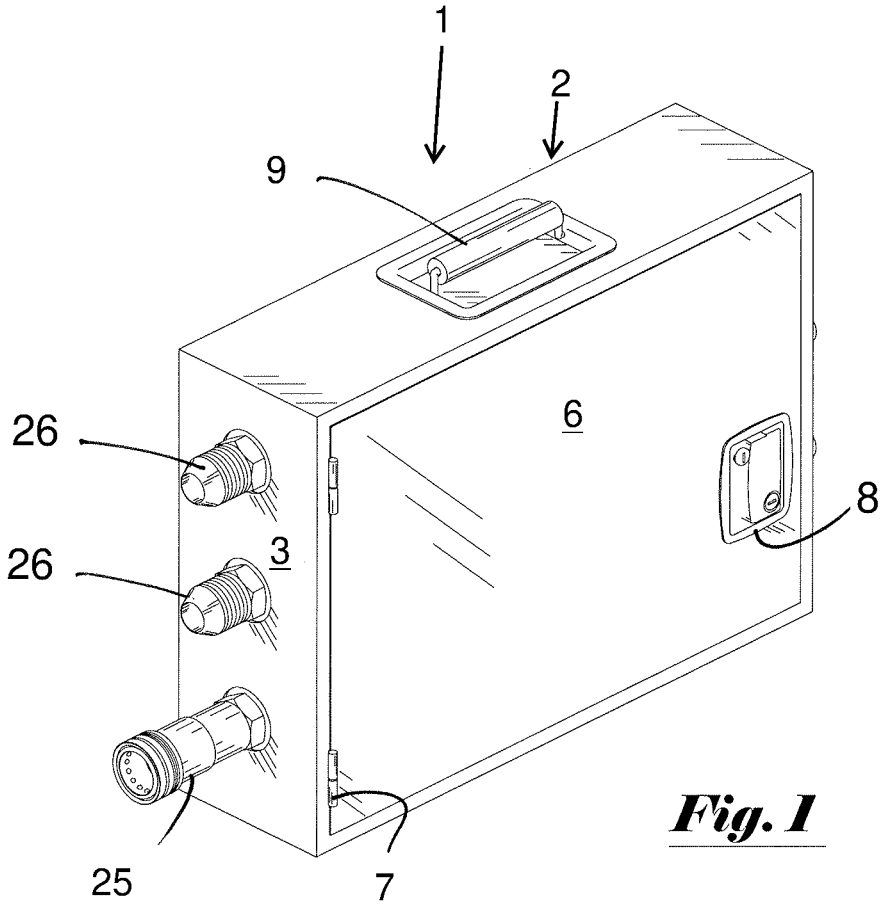
FIG. 1 is a perspective view of one embodiment of the transfer unit or transfer box of the present invention.
Figure 2:
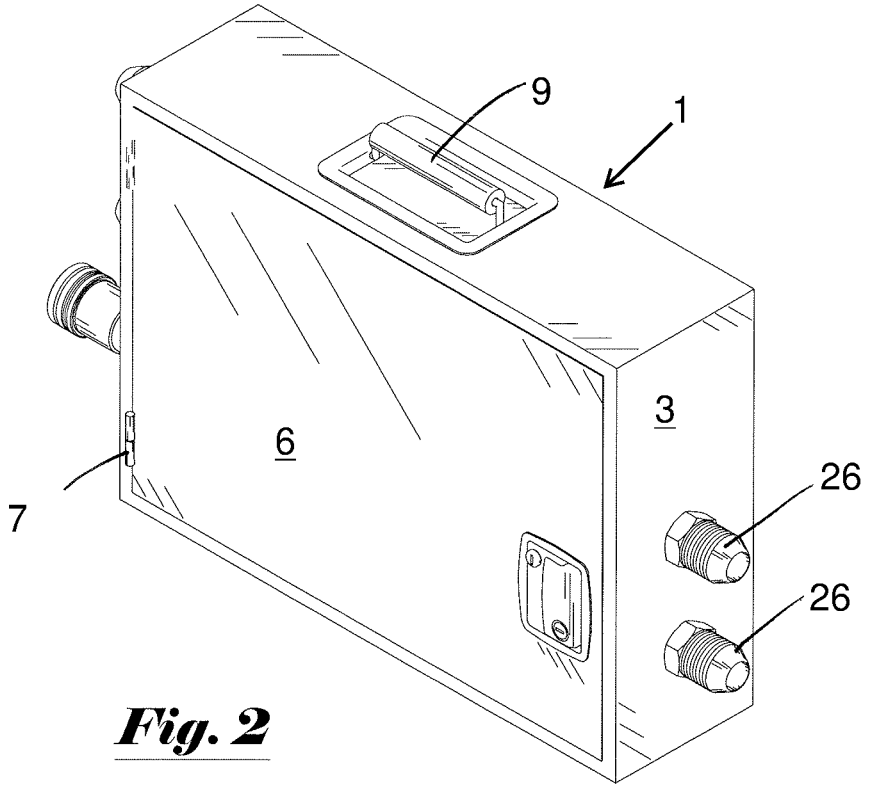
FIG. 2 is a modified perspective view of the FIG. 1 transfer unit.
Figure 3:
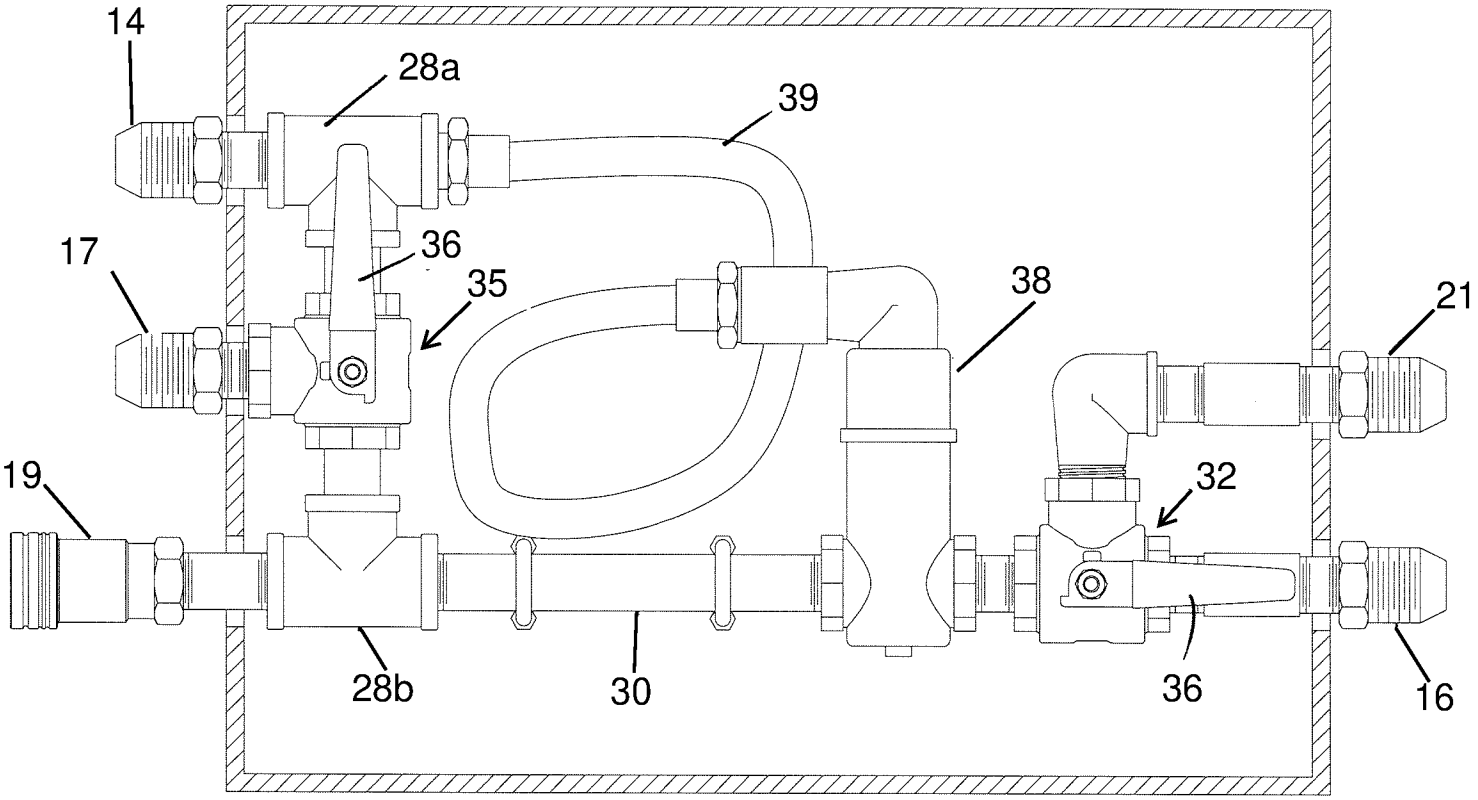
FIG. 3 is an internal view of the components in the FIG. 1 transfer unit.

As suggested above, a "transfer unit" is typically interconnected between the fuel supply unit and the engine unit. FIGS. 1 to 3 illustrate one embodiment of transfer unit 1. FIGS. 1 and 2 show the exterior housing 2 of transfer unit 1. Housing 2 is generally formed of four sidewalls 3 together with front wall 6 and a rear wall (hidden from view). As the front wall is attached to one of the sidewalls 3 with hinges 7, the front wall also forms the door 6 and can be opened or maintained in the closed position by conventional door latch 8. In a preferred embodiment, door latch 8 is a selectively lockable door latch. Additionally, a carrying handle 9 is positioned on the upper sidewall 3. A female hose connector 25 and several male hose connectors 26 are shown extending from two of the sidewalls 3. When transfer unit 1 is in the box-like or case-like configuration shown in FIGS. 1-3, it may sometimes be referred to as the fuel "transfer box" or "transfer case." Typically, the volume of transfer unit 1 is less than 10 $ft^3$, alternatively less than 5 $ft^3$, more preferably between 3 $ft^3$ and 0.5 $ft^3$, with most preferably, the volume being about 1 $ft^3$. Transfer unit 1 is preferably constructed of a light-weight metal such as an aluminum alloy.

Figure 4B:
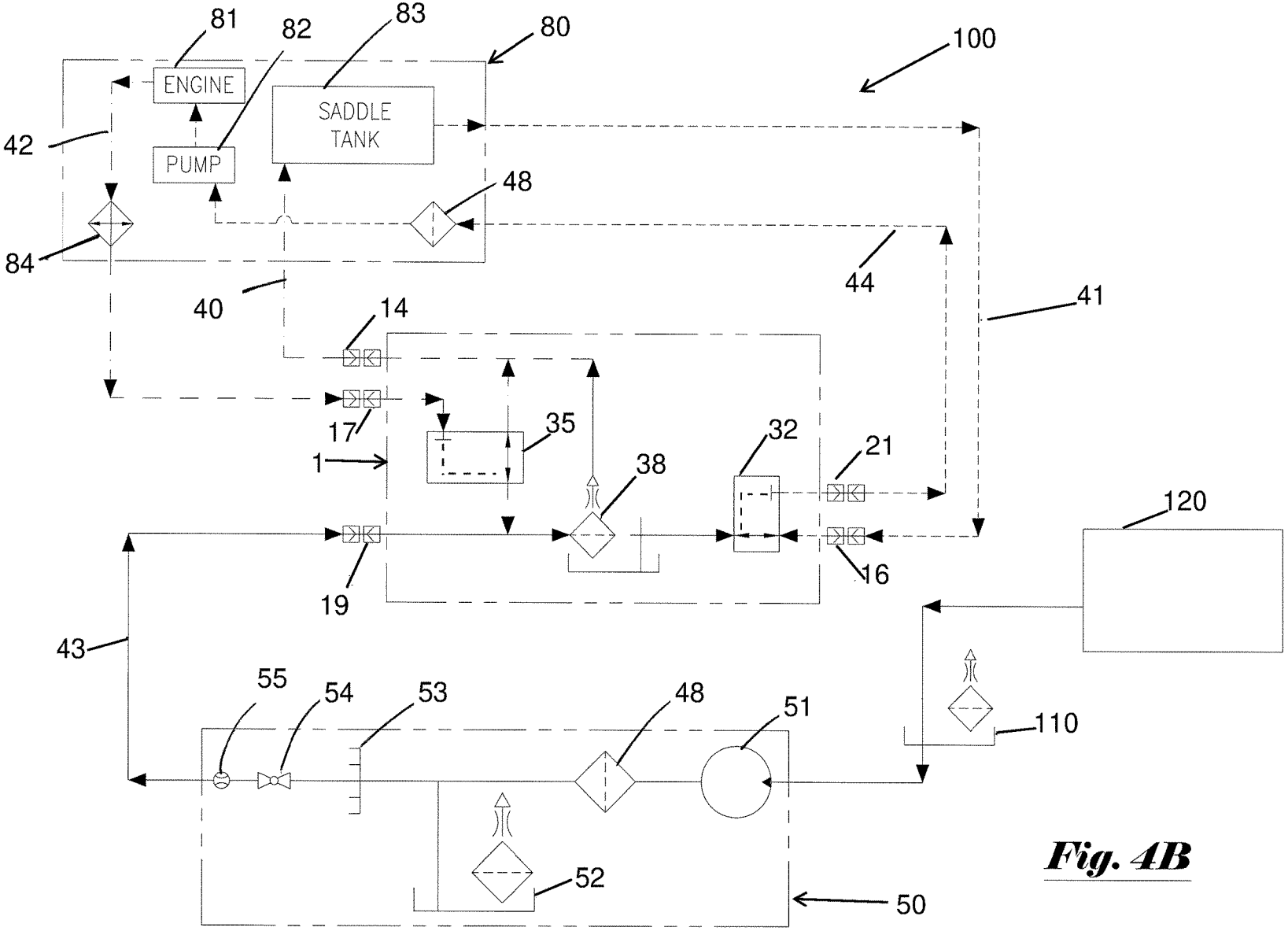
FIG. 4B is the FIG. 4A flow diagram showing alternative fluid paths.

FIG. 3 shows the components positioned in the interior of housing 2. In FIG. 3, the male hose connectors 26 and female hose connector 25 are also designated by fluid paths they establish or form part of as seen in FIGS. 4A and 4B. Thus, one male hose connector is referred to as outflow to the saddle tank connector 14, another inflow from saddle tank connector 16, engine return inlet connector 17, and outflow to engine pump connector 21. The female connector 25 serves as the main fuel supply inlet connector 19. Main fuel supply inlet connector 19 initially feeds into the tee connection 28*b* which creates a common path between both three-way diverter valve 35 and to conduit section 30 (e.g., a threaded pipe section). Conduit section 30 directs fuel into air eliminator 38 which is in turn connected to three-way diverter valve 32. Air eliminator 38 is a conventional device which provides a space for air bubbles entrained in the fuel arriving from conduit 30 to escape prior to the fuel moving into three-way valve 32. The handle 36 of three-way diverter valve 32 has (i) a first position which connects fuel flowing through air eliminator 38 to the outflow to engine pump connector 21, and (ii) a second position which connects inflow from saddle tank connector 16 to outflow to engine pump connector 21. The air eliminator line 39 extending from air eliminator 38 is connected to tee connection 28*a*, which provides connection to outflow to saddle tank connector 14 and three-way diverter valve 35. The handle 36 of three-way diverter valve 35 has (i) a first position which connects fuel flowing from engine return inlet connector 17 to the tee connection 28*b*, and (ii) a second position which connects engine return inlet connector 17 to outflow to saddle tank connector 14.

The alternative flow paths established between engine unit 80, transfer unit 1, and fuel supply unit 50 by the positioning of three-way valves 32 and 35 are best understood by viewing FIGS. 4A and 4B. In FIG. 4A, three-way valve 32 has been positioned such that fuel flowing into transfer unit 1 from fuel supply line 43 enters the transfer unit 1 at fuel supply inlet connector 19, moves through air eliminator 38 to three-way valve 32, is directed to outflow to engine pump connector 21, and its associated pump outflow line 44, which sends fuel through filter 48 positioned on the filter rail, pump 82, and ultimately to engine 81. More concisely, this may be considered a flow path directing fuel from the manifold 53 outlet to the engine pump and is shown with shorter dashed lines (--------) FIG. 4A similarly shows three-way valve 35 positioned such that engine return line 42 directs fuel (e.g., excess diesel fuel returned from the injector pump and injectors) through fuel cooler 84 to engine return inlet connector 17 and back to the main fuel supply line in transfer unit 1 (i.e., via tee connection 28*b* to conduit 30 shown in FIG. 3). This path can be concisely described as directing fuel from the engine to conduit 30 (i.e., part of the first path) and is shown with longer dashed lines (-- -- -- -- --).

FIG. 4B illustrates the alternate positioning of three-way valves 32 and 35. In FIG. 4B, three-way valve 32 is positioned such that fuel from saddle tank 83 is circulated through saddle tank outflow line 41 to inflow from saddle tank connector 16, then to outflow to engine pump connector 21, and then through engine pump line 44 to pump 82 and ultimately to engine 81. This path may be more concisely referred to as directing fuel from the saddle tank to the engine pump and is shown with the shorter dashed lines. Simultaneously, three-way valve 35 in its alternate position directs fuel returning from engine return line 42 and fuel cooler 84 through engine return inlet connector 17 and outflow saddle tank connector 14, to saddle tank inflow line 40 and ultimately back to saddle tank 83. This path can be concisely described as directing return fuel from the engine to the saddle tank and is shown with the longer dashed lines.

Many different configurations of the fuel supply system are possible. For example, the fuel supply pump 51 shown in FIG. 4A may be configured to automatically pull fuel from slave tank 110 in order to maintain a minimum fuel level in the supply tank 52. By maintaining a minimum level in supply tank 52, fuel may be gravity fed through manifold 53, thereby eliminating the need for a pump between the supply tank and manifold. In another example suggested in FIG. 5, the manifold 53 (seen in FIG. 4A) has multiple outlets, with each manifold outlet connecting to a separate fuel transfer unit 1, and each of the transfer units 1 connecting to a separate engine unit 80. In many embodiments, the engine unit 80 and the transfer unit(s) 1 will be positioned in a "hot zone" around the well site, while the fuel supply unit 50 will be positioned outside of this hot zone.

Although many embodiments of the transfer unit 1 have been described in the context of multiple components disposed within a housing 2 (e.g., see FIGS. 1 and 2), alternative embodiments of the transfer unit 1 may dispense with the use of a housing 2 and instead comprise fuel lines coupled to an air eliminator and one or more valves. For example, in a further alternative embodiment, a fuel supply system embodying the principles of the present invention may comprise a first fuel line configured to receive fuel from an outlet of the manifold and direct fuel to at least one of the engine pump or fuel saddle tank. Then a second fuel line may be configured to receive return fuel from the engine via the fuel cooler, and to direct fuel back into the first fuel line. This embodiment may include three way valves such as describe above, but such valves are not necessary if it is acceptable to have a fixed fuel flow configuration. Also, the air eliminator could be positioned anywhere between the point at which the second fuel line feeds into the first fuel line and/or the engine unit (e.g., anywhere in line 44 seen in FIG. 4A).

The term "about" will typically mean a numerical value which is approximate and whose small variation would not significantly affect the practice of the disclosed embodiments. Where a numerical limitation is used, unless indicated otherwise by the context, "about" means the numerical value can vary by +/−5%, +/−10%, or in certain embodiments +/−15%, or even possibly as much as +/−20%. Similarly, "substantially" will typically mean at least 85% to 99% of the characteristic modified by the term. For example, "substantially all" will mean at least 85%, at least 90%, or at least 95%, etc.

What is claimed is:

1. A fuel supply system for establishing a fuel supply into a wellsite hot-zone, the fuel supply system comprising:

(a) an engine unit including an engine, a fuel saddle tank, and an engine pump adapted to deliver fuel to the engine;

(b) a fuel supply unit spaced apart from the engine unit and including a fuel supply tank, a supply pump configured to transfer fuel to the fuel supply tank, and a manifold receiving fuel from the fuel supply tank;

(c) a transfer unit, the transfer unit comprising: (i) a supply inlet for receiving fuel from an outlet of the manifold of the fuel supply unit; (ii) an engine return inlet for receiving unburnt fuel leaving the engine; (iii) a saddle tank outlet for transferring fuel from the transfer unit into the fuel saddle tank; (iv) a saddle tank inlet for receiving fuel from the fuel saddle tank; (v) an engine supply outlet for transferring fuel from the transfer unit to the engine; (vi) a first diverter valve operatively connecting the supply inlet, the engine return inlet, and the saddle tank outlet; (vii) a second diverter valve operatively connecting the saddle tank inlet and the engine supply outlet; (viii) an air eliminator positioned between the first diverter valve and the second diverter valve; (ix) a first conduit fluidly connecting the first diverter valve to the air eliminator; and (x) a second conduit fluidly connecting the air eliminator to the second diverter valve.

2. The fuel supply system of claim 1, wherein an outlet of the fuel supply tank is between about 1 foot and about 10 feet in elevation above the supply inlet of the transfer unit.

3. The fuel supply system of claim 2, wherein the outlet of the fuel supply tank is between about 1 foot and about 5 feet in elevation above the supply inlet of the transfer unit.

4. The fuel supply system of claim 1, wherein the fuel supply tank has a capacity of between about 1000 gallons and 5000 gallons.

5. The fuel supply system of claim 1, wherein the fuel supply unit is formed on a wheeled chassis.

6. The fuel supply system of claim 1, wherein the transfer unit comprises a housing in the shape of a rectangular box with one face of the rectangular box configured to open thereby providing access to an interior of the box.

7. The fuel supply system of claim 6, wherein a volume of the housing is between about 0.5 $ft^3$ and about 3.0 $ft^3$.

8. The fuel supply system of claim 1, wherein:

(i) the transfer unit includes a plurality of transfer units;

(ii) the engine unit includes a plurality of engine units; and (iii) the manifold has multiple manifold outlets, with each of the manifold outlets connecting to a respective one of the transfer units, and each of the transfer units connecting to a respective one of the engine units.

9. The fuel supply system of claim 1, wherein the engine unit is at least one from the group consisting of (i) a frac unit, (ii) a blender unit, (iii) a hydration unit, and (iv) a pump-down engine.

10. The fuel supply system of claim 1, wherein no pump exists between the fuel supply tank and the manifold.

11. The fuel supply system of claim 1, wherein the engine unit is positioned in the wellsite hot-zone and the fuel supply unit is positioned outside the wellsite hot-zone.

12. The fuel supply system of claim 11, wherein the transfer unit is positioned outside the wellsite hot-zone.

13. The fuel supply system of claim 11, wherein the transfer unit is positioned inside the wellsite hot-zone.

14. The fuel supply system of claim 1, wherein the engine unit includes a fuel cooler reducing a temperature of fuel prior to its return to the transfer unit.

15. A fuel supply system establishing a fuel supply into a wellsite hot-zone, the fuel supply system comprising:

(a) an engine unit including an engine, a fuel saddle tank, and an engine pump adapted to deliver fuel to the engine;

(b) a fuel supply unit spaced apart from the engine unit and including a fuel supply tank, a supply pump configured to transfer fuel to the fuel supply tank, and a manifold receiving fuel from the fuel supply tank;

(c) a first valve configured to selectively receive fuel from either (i) an outlet of the manifold via a first fuel line, or (ii) the fuel saddle tank, and direct fuel to the engine pump;

(d) a second valve configured to receive return fuel from the engine and a fuel cooler, and to selectively direct return fuel back into either (i) the first fuel line, or (ii) the fuel saddle tank; and (e) wherein the first valve and the second valve are enclosed within a fuel transfer unit having sidewalls defining a volume of less than 3 $ft^3$.

16. The fuel supply system of claim 15, wherein an air eliminator is positioned in the first fuel line at a point between (i) the outlet of the manifold, and (ii) the engine unit.

* * * * *